US009410401B2

(12) United States Patent
Cox et al.

(10) Patent No.: US 9,410,401 B2
(45) Date of Patent: Aug. 9, 2016

(54) METHOD AND APPARATUS FOR ACTUATION OF DOWNHOLE SLEEVES AND OTHER DEVICES

(71) Applicant: COMPLETION INNOVATIONS, LLC, Lafayette, LA (US)

(72) Inventors: Blake Cox, Houston, TX (US); Loren McNeely, Broussard, LA (US); Glen W. Holcomb, New Iberia, LA (US)

(73) Assignee: Completion Innovations, LLC, Lafayette, LA (US)

( * ) Notice: Subject to any disclaimer, the term of this patent is extended or adjusted under 35 U.S.C. 154(b) by 386 days.

(21) Appl. No.: 14/206,403

(22) Filed: Mar. 12, 2014

(65) Prior Publication Data

US 2014/0262323 A1 Sep. 18, 2014

Related U.S. Application Data

(60) Provisional application No. 61/778,896, filed on Mar. 13, 2013.

(51) Int. Cl.

| | |
|---|---|
| ***E21B 34/14*** | (2006.01) |
| ***E21B 34/06*** | (2006.01) |
| *E21B 34/00* | (2006.01) |

(52) U.S. Cl.

CPC ..... *E21B 34/14* (2013.01); *E21B 34/066* (2013.01); *E21B 2034/005* (2013.01)

(58) Field of Classification Search

CPC ..... E21B 34/066; E21B 34/10; E21B 34/102; E21B 34/12; E21B 34/14; E21B 34/108

USPC ..... 166/66.6, 66.7, 332.1, 332.8, 334.1, 166/334.4, 318, 373

See application file for complete search history.

(56) References Cited

U.S. PATENT DOCUMENTS

| | | | |
|---|---|---|---|
| 2,856,692 | A | 10/1958 | Banning |
| 5,293,945 | A | 3/1994 | Rosenhauch et al. |

(Continued)

FOREIGN PATENT DOCUMENTS

| | | |
|---|---|---|
| GB | 961901 | 6/1964 |
| WO | 2012045165 A1 | 4/2012 |

OTHER PUBLICATIONS

PCT International Search Report and Written Opinion dated Jul. 24, 2014.

*Primary Examiner* — Kenneth L Thompson

(74) *Attorney, Agent, or Firm* — Ted M. Anthony

(57) ABSTRACT

A downhole equalization assembly permits selective and remote opening of at least one downhole port or pathway to allow communication of pressure and/or fluid flow from inside a pressure containing system (such as, for example, a tubular pipe or other pressure containment system) to the outside of the containment system, or vice versa. A control device generating a magnetic field is inserted into a well and conveyed to a downhole equalization assembly. When the control device passes through an equalization assembly, an electrical current is generated that triggers an electronic counter. When a predetermined counter number is reached, a sliding sleeve is shifted, thereby exposing ports and/or pathways extending between the inside and outside of the equalization assembly. No physical contact or mechanical interference is required between the control device and any other components in order to actuate the equalization assembly.

16 Claims, 6 Drawing Sheets

(56) References Cited

U.S. PATENT DOCUMENTS 5,310,005 A 5/1994 Dollison
8,210,258 B2 * 7/2012 O'Malley ..... E21B 47/10 166/250.01
8,393,386 B2 * 3/2013 Lake ..... E21B 34/066 166/373
8,910,716 B2 * 12/2014 Newton ..... E21B 43/12 166/191
9,010,447 B2 * 4/2015 Themig ..... E21B 34/14 166/318
9,062,516 B2 * 6/2015 Fripp ..... E21B 34/16
9,284,817 B2 * 3/2016 Walton ..... E21B 34/06
2010/0314562 A1 * 12/2010 Bisset ..... E21B 34/06 251/12
2011/0240311 A1 10/2011 Robison et al.
2011/0278017 A1 11/2011 Themig et al.
2012/0085538 A1 * 4/2012 Guerrero ..... E21B 33/12 166/284
2013/0206402 A1 * 8/2013 Coon ..... E21B 23/08 166/255.1
2014/0299330 A1 * 10/2014 Fripp ..... E21B 34/108 166/373
2015/0027723 A1 * 1/2015 Fripp ..... G01V 11/002 166/373
2015/0027724 A1 * 1/2015 Symms ..... E21B 34/16 166/373

* cited by examiner

METHOD AND APPARATUS FOR ACTUATION OF DOWNHOLE SLEEVES AND OTHER DEVICES

CROSS REFERENCES TO RELATED APPLICATION

Priority of U.S. Provisional Patent Application Ser. No. 61/778,896, filed Mar. 13, 2013, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to an assembly having flow ports that can be selectively actuated or opened by non-mechanical interference to permit communication of fluids and pressure between a first region and a second region. More particularly, the present invention pertains to a downhole sleeve assembly, beneficially includable within a tubular string or other tool assembly, having ports capable of being selectively opened to permit fluid pressure communication and fluid flow through said ports.

2. Brief Description of the Prior Art

From time to time it is advantageous, while controlling fluid flow and/or pressure in a system having an inside and an outside, to selectively open said system to allow fluid to flow and pressure to equalize between said inside and outside of said system. Although other applications can be envisioned, one such situation in which such selective opening is particularly beneficial is in connection with oil and/or gas wells and, more particularly, the stimulation, completion and production thereof.

Horizontal and/or non-vertical directional wells have become common, particularly as technology for drilling, completing and stimulating such wells in shale formations and/or other low permeability reservoirs has improved. However, even with advances in drilling technology, certain limitations exist that prevent optimization of the completion and stimulation of such horizontal and/or extended reach wells. Notably, although current drilling technology has increased the length that non-vertical or horizontal well sections can be drilled, such drilling technology has generally outpaced the ability to stimulate and produce oil and gas from such extended well sections.

One important factor that limits or restricts recovery from extended reach wells is the number of stimulation stages or points that can be effectively deployed in order to treat or stimulate all portions of such wells. Without a viable means of stimulating substantially the entire length of an extended well, the full potential of such deeper (or longer) wells cannot be realized. Put another way, the full benefits of extended reach wells are typically not realized if such wells cannot be stimulated along substantially their entire length.

Several methods are currently utilized to create an opening in wellbore tubular goods in order to equalize pressure and allow fluids to flow between the inside and the outside of said tubular goods. In most instances, said openings are designed to permit: (1) flow of stimulation (such as, for example, hydraulic fracturing) materials from the inside of wellbore tubular goods to reservoir(s) surrounding the outer surface of such tubular goods, and/or (2) production of fluids from such surrounding reservoir(s) into such wellbore tubular goods.

One existing method of creating such openings in wellbore tubular goods involves the use perforating guns which are lowered to a desired location within a well via wireline or tubing. Such perforating guns, which typically employ directional explosive charges, are remotely triggered in order to perforate the walls of such tubular goods. Unfortunately, there are practical limits to the depths/lengths within a wellbore at which such operations can be performed such as, for example, frictional limitations on the length of wireline or tubing that can be used to convey said perforating guns into a well.

Yet another conventional method of establishing communication between the inside and outside of wellbore tubular goods involves use of continuous or jointed tubing equipped with a specialized cutting device(s). Such a device is lowered into a well to a desired location and sand slurry or other abrasive fluid is pumped to the bottom of the continuous or jointed tubing; the abrasive fluid exits the device and erodes opening(s) in a surrounding wellbore tubular using the abrasive effect of such fluid. However, this method is also limited by the practical length that such continuous or other concentric tubing can be conveyed within a well, primarily due to wall frictional forces generated between such continuous/jointed tubing, and said surrounding wellbore tubular goods.

Another method commonly used for creating such downhole opening(s) in wellbore tubular goods involves the installation of at least one ported sliding sleeve and/or other similar apparatus at desired location(s) down hole (such as, for example, on or as part of a production casing string). When desired, such sleeve(s) can be selectively opened by mechanically manipulating the devices, typically using tools that are conveyed into a well via continuous tubing or wireline, thereby exposing such ports. However, use of such sliding sleeves or other similar devices also suffer from significant operational limitations. As with tubing perforation operations described above, frictional forces also limit the length of wireline or tubing that can be used for purposes of shifting or actuating such downhole sliding sleeves.

Certain other conventional downhole assemblies can be selectively opened using droppable or so-called "pump-down" objects such as, for example, balls or darts. Such conventional assemblies are typically operated by a sequence in which a small ball or dart is first dropped downhole. Said first ball or dart lands on a corresponding seat assembly, thereby blocking a fluid flow bore. Application of fluid pressure to said blocked bore facilitates actuation of said sleeve assembly. Thereafter, a slightly larger ball or dart can be dropped to land on a correspondingly sized seat in order to actuate a different sleeve assembly positioned further up hole.

This process can be repeated (generally moving from the deepest or furthest end of the well toward the surface) with each successive ball or dart having a larger outside diameter than the immediately preceding ball or dart. It is to be observed that the overall number of balls or darts that can be used in this manner is limited by the inside diameter of the surrounding tubular. As such, the total number of selectively actuated sliding sleeve assemblies that can be used is likewise limited.

Certain other devices utilize a consistently-sized droppable object (such as, for example, a plurality of balls all having a uniform outside diameter) to engage and operate a selectively actuated downhole apparatus. However, such devices generally require complex mechanical assemblies to operate. Use of such mechanical assemblies are particularly problematic during cementing and stimulation operations, because cement and stimulation proppant material (such as, for example, "frac sand" used in hydraulic fracturing operations) can invade such mechanical assemblies and negatively affect their operation.

The equalization assembly of the present invention overcomes the limitations of existing methods, permitting wells to be drilled with longer extended sections and to be optimally stimulated for greater production rates.

SUMMARY OF THE INVENTION

The present invention comprises a ported assembly that permits selective and remote opening of at least one downhole port or pathway to allow communication of pressure and/or fluid flow between the inside of a pressure containing system (such as, for example, a tubular pipe or other separate pressure containment system) and the outside of said containment system. Although other applications can be envisioned, the ported assembly of the present invention can be utilized in connection with oil and/or gas wells and, more particularly, the stimulation, completion and production thereof.

In a preferred embodiment, the present invention comprises a valve assembly, sometimes referred to herein as an "equalization assembly," that can be installed downhole at a desired location within a well bore. Although many different applications can be envisioned, the ported equalization assembly of the present invention can be installed on a production tubular (such as production casing or the like) within a vertical, directional or horizontal wellbore, and conveyed to a desired depth within said wellbore. Frequently, multiple equalization assemblies can be installed in sequence and spaced apart at desired intervals along the length of said wellbore. Further, said production tubular can be either cemented in place or left un-cemented, using packers or other sealing devices to isolate annular spaces between individual equalization assemblies.

Each equalization assembly has at least one transverse port or pathway extending from the inside to the outside of said assembly. When opened, said at least one port and/or pathway provides a flow path to permit fluid to flow and pressure to equalize between the inside and outside of said tubular. Moreover, when opened said port(s) and/or pathways provide a flow path for stimulation media such as fluids, gasses and proppants to be injected through said well bore and into the surrounding formation (typically during the completion phase of the well), while also providing a flow path for fluids from such formation(s) into the inside of the tubular (typically during the production phase of the well).

In a preferred embodiment, a control device (including, without limitation, a dart, ball, canister or threaded device) can be inserted into a well at the earth's surface and conveyed to said at least one downhole equalization assembly via various means (including, without limitation, via flowing fluid, wire line, continuous tubing and jointed pipe). Said control device contains at least one magnet or other device generating a desired magnetic field, and may optionally contain batteries or other power source(s).

The equalization assembly of the present invention further comprises a pressure balanced sliding sleeve. An incompressible fluid holds said sliding sleeve in a closed and locked position; in the closed position, said sliding sleeve blocks said transverse port(s) of the assembly. The equalization assembly of the present invention further comprises an electrical induction coil, an electronic counter, a valve controlling said incompressible fluid, and a magnetic solenoid.

When the control device passes through each equalization assembly an electrical current is generated in the induction coil of said equalization assembly. Said current eventually triggers said electronic counter. Each equalization assembly (s) can be beneficially preset with a desired counter number. When such number is reached for a specific sleeve(s), an electronic pulse will pass through the electronic counter and power said magnetic solenoid. At that point, said magnetic solenoid can open the containment valve allowing the incompressible fluid to displace into the solenoid chamber. The internal pressure inside the tubular causes the unbalanced sliding sleeve to shift, thus exposing ports and/or pathways extending between the inside and outside of the tubular through the equalization assembly(s). In one configuration an internal valve can then close to prevent fluid from flowing past the selected equalization assembly(s). In a second configuration the sliding sleeve can slide open without an internal valve closing allowing fluid to flow past the open assembly.

With the desired port(s) and/or pathways open, proppant and/or stimulation media can be pumped through the inner bore of the tubular goods, out the exposed port(s) or pathway (s) of the equalization assembly(s), and into the area surrounding said equalization assembly(s). Said open port(s)/pathway(s) also allow production fluids (for example, oil and/or gas) to flow from a surrounding reservoir into the inner bore of said tubular during a production phase for eventual recovery from said well.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
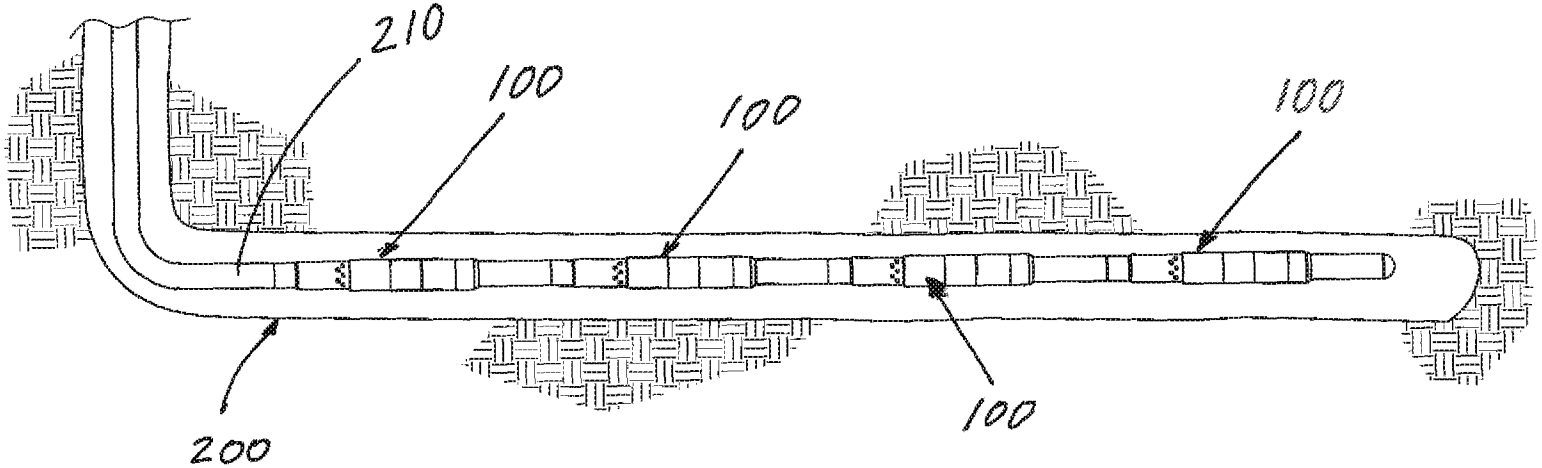
FIG. 1 depicts a side view of multiple equalization assemblies of the present invention deployed within a well bore.

Referring to the drawings, FIG. 1 depicts a side view of multiple equalization assemblies 100 of the present invention deployed in sequence within in a well bore 200. Although other applications can be envisioned without departing from the scope of the present invention, in a preferred embodiment said equalization assemblies 100 depicted in FIG. 1 are used in connection with the stimulation and subsequent producing phase of wellbore 200 drilled for the purpose of producing hydrocarbons from surrounding subterranean formation(s). Wellbore 200 is depicted in FIG. 1 as a substantially horizontal well; however, it is to be observed that equalization assembly 100 of the present invention can likewise be used in vertical or non-horizontal directional wellbores.

After a well (such as wellbore 200) is drilled to a desired depth, pipe or other tubular goods are installed and cemented within said well. Thereafter, openings or flow ports in wellbore tubular goods must be provided in order to equalize fluid pressure and allow fluids to flow between the inside and the outside of said tubular goods (and vice versa). Said openings can beneficially permit flow of stimulation (such as, for example, hydraulic fracturing) materials from the inside of wellbore tubular goods to reservoir(s) surrounding the outer surface of such tubular goods, as well as inflow of fluids from such surrounding reservoir(s) into said wellbore tubular goods. Equalization assembly 100 generally comprises an assembly having flow ports that can be selectively actuated via non-mechanical interference in order to allow communication of fluids and pressure between a first region and a second region.

As depicted in FIG. 1, in a preferred embodiment equalization assemblies 100 are threadably connected within a tubular string 210 and conveyed via said tubular string 210 to a predetermined position in wellbore 200. After being properly positioned within wellbore 200, tubular string 210 can then be cemented in place or left un-cemented. Equalization assemblies 100 can be configured in series with said assemblies being preset to actuate individually, together, or in distinct groups of two or more.

Figure 2A:
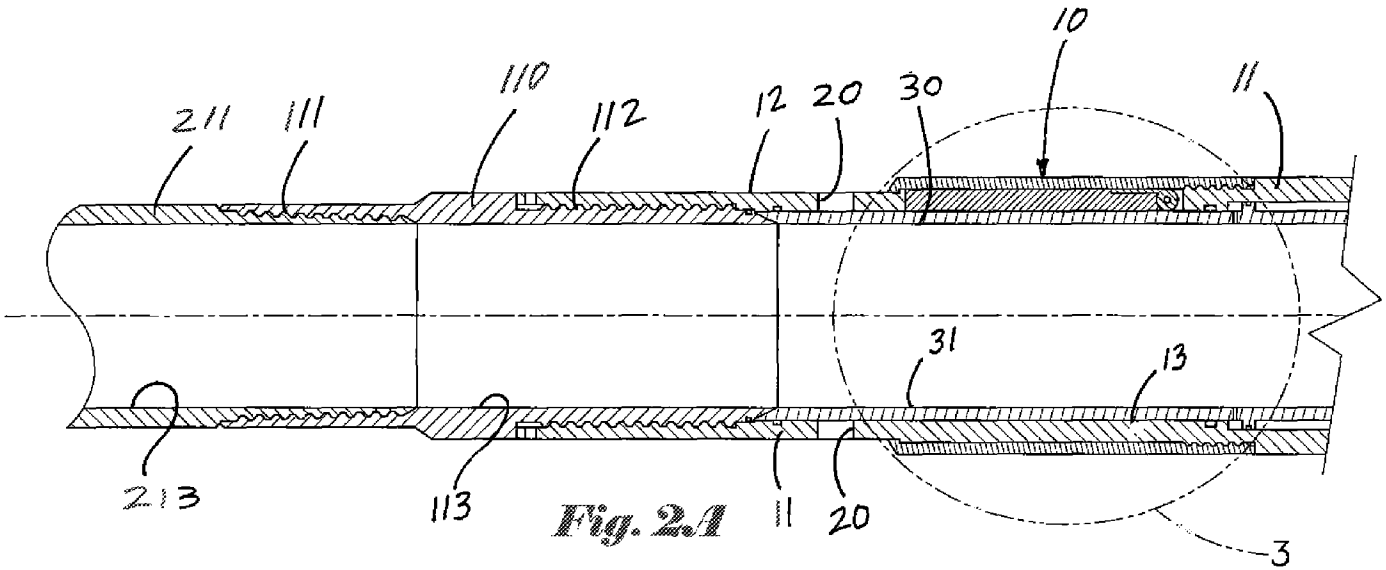
FIG. 2A depicts a side sectional view of a valve subassembly of an equalization assembly of the present invention.
Figure 2B:
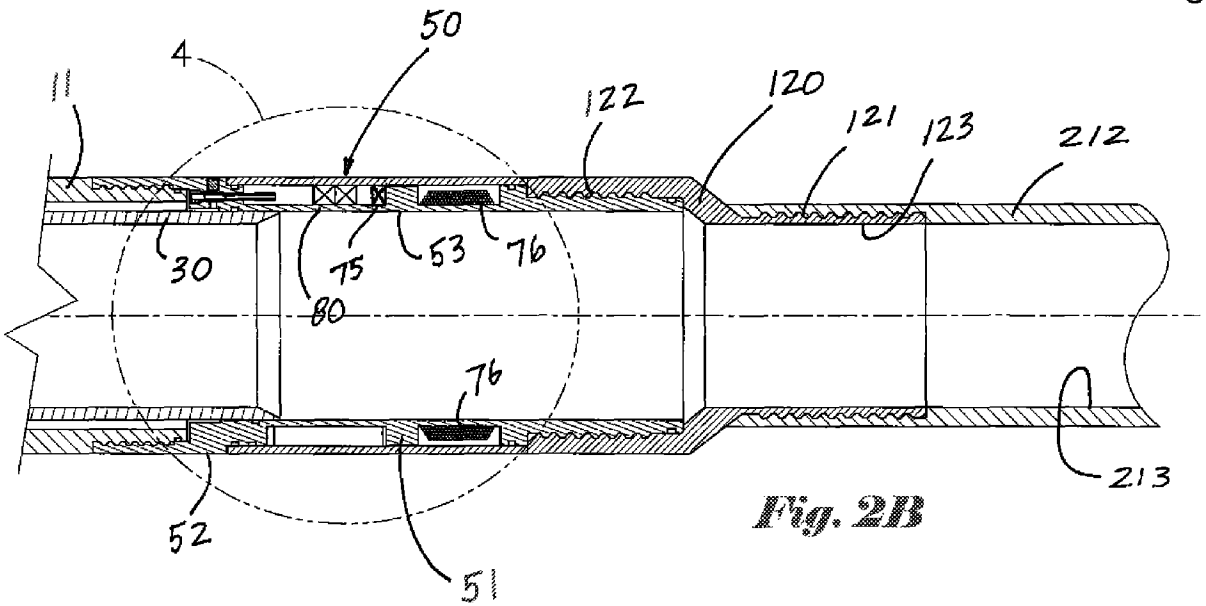
FIG. 2B depicts a side sectional view of an actuation subassembly of an equalization assembly of the present invention.

FIG. 2A depicts a side sectional view of a valve sub-assembly 10 of equalization assembly 100 of the present invention, while FIG. 2B depicts a side sectional view of actuation sub-assembly 20 of equalization assembly 100 of the present invention. In a preferred embodiment, equalization assembly 100 is threadably connected at one end to tubular member 211 using cross-over sub 110 having threaded connections 111 and 112. Similarly, equalization assembly 100 is threadably connected at another end to tubular member 212 using cross-over sub 120 having threaded connections 121 and 122.

Tubular members 211 and 212, which comprise components of tubular string 210, each have central through-bore 213 which defines an internal passage through said tubular members 211 and 212. Cross-over sub 110 has central through-bore 113 defining an internal passage through said cross-over sub 110, while cross-over sub 120 has central through-bore 123 defining an internal passage through said cross-over sub 120.

Referring to FIG. 2A, equalization assembly 100 comprises substantially cylindrical external housing member 11 having an outer surface 12 and a central through-bore defining inner surface 13. A plurality of transverse equalization ports 20 extend through said housing member 11 from said inner surface 13 to said outer surface 12. Equalization ports 20 can be equipped with optional threaded or pressed nozzles that can limit the flow of liquids and gases that can pass through said equalization ports 20, either initially or permanently.

Sleeve member 30, having a central through-bore defining inner surface 31, is slidably disposed within the central through-bore of external housing member 11. In the "closed" configuration depicted in FIG. 2A, sleeve member 30 obstructs equalization ports 20. As such, in said closed position, sleeve member 30 isolates fluid pressure and flow through said equalization ports 20.

Referring to FIG. 2B, equalization assembly 100 further comprises actuation sub body member 51 having an outer surface 52 and a central through-bore defining inner surface 53. As depicted in FIG. 2B, sleeve member 30 only partially extends into said through-bore; however, it is to be observed that said through-bore of said actuation sub body member 51 has a sufficiently large inner diameter to receive said sleeve member 30.

Figure 3:
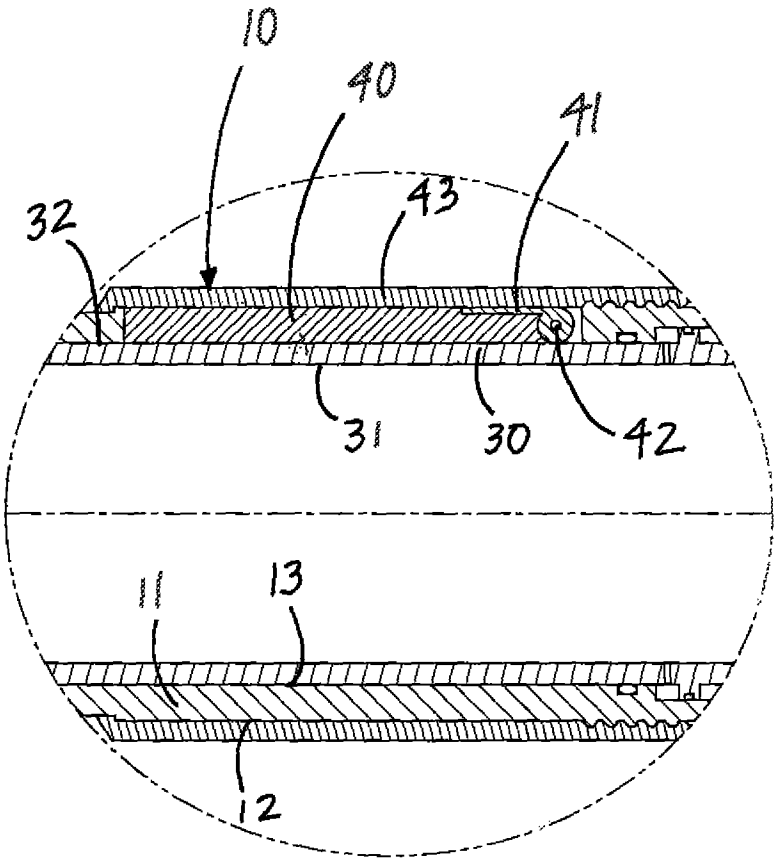
FIG. 3 depicts a detailed view of the area highlighted in FIG. 2A.

FIG. 3 depicts a detailed view of valve sub-assembly 10 highlighted in FIG. 2A. Cylindrical external housing member 11 has an outer surface 12 and a central through-bore defining inner surface 13. Sleeve member 30, having a central through-bore defining inner surface 31, is slidably disposed within the central through-bore of said external housing member 11. Flapper 40 is hingedly connected to external housing member 11 using flapper hinge 41 and hinge pin 42. As depicted in FIG. 3, hinge member 40 is maintained in an open or retracted position by sleeve member 30, while flapper cover 43 extends around the external portion of said flapper 40.

Figure 4:
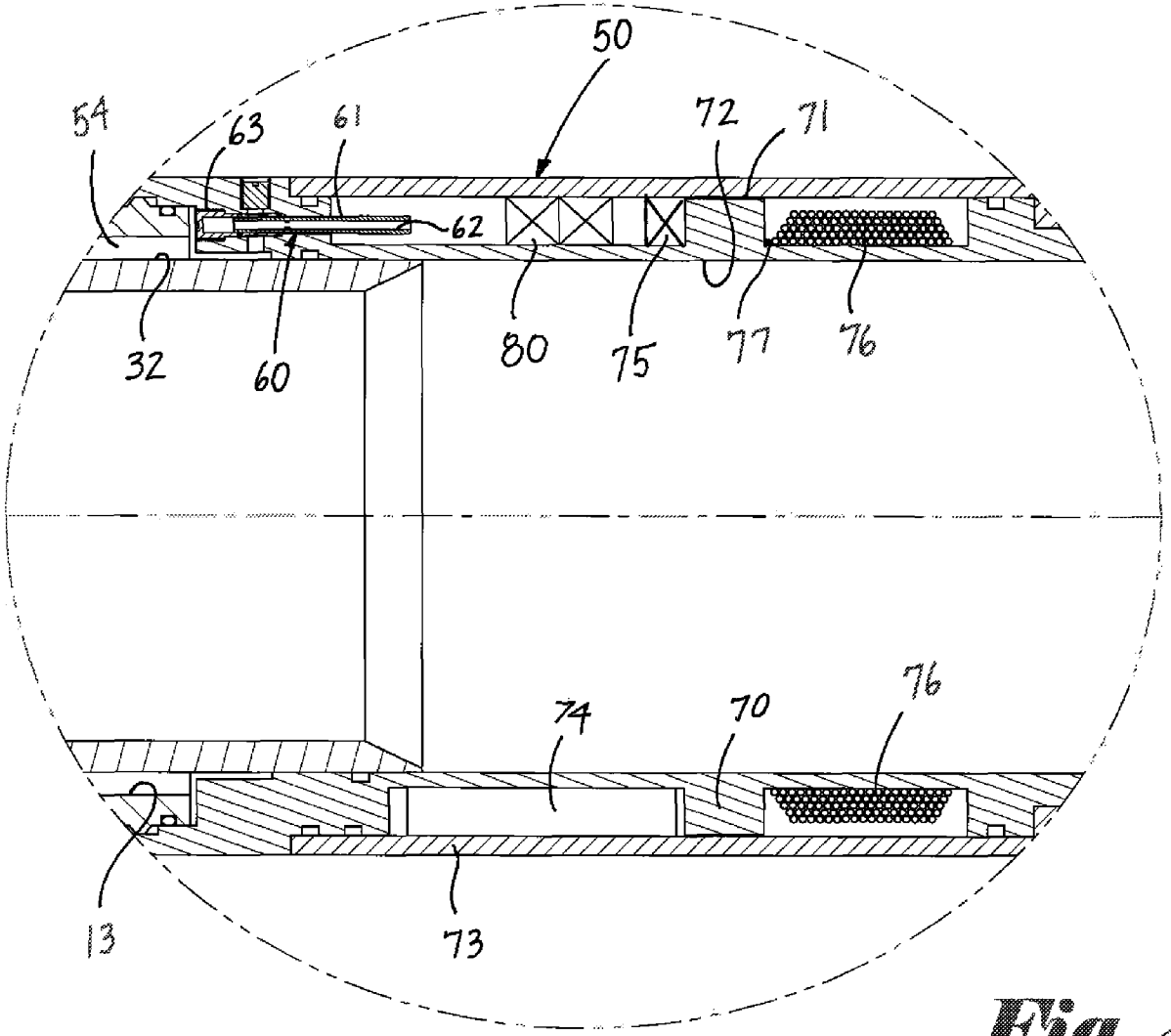
FIG. 4 depicts a detailed view of the area highlighted in FIG. 2B.

FIG. 4 depicts a detailed view of actuation sub-assembly 50 highlighted in FIG. 2B. A reservoir or chamber 54 is defined between inner surface 13 of external housing member 11 and outer surface 32 of sleeve member 30. In a preferred embodiment, said chamber 54 is filled with an incompressible liquid having desired characteristics. Said incompressible fluid is sealed within said chamber 54 using fluid pressure seals (such as, for example, elastomeric o-rings disposed around the outer surface 32 of sleeve member 30). Electronics housing member 70, connected to external housing member 11, has an outer surface 71 and a central through-bore defining inner surface 72. Sleeve-like electronic sub cover 73 is disposed around at least a portion of said electronics housing member 70.

Flow channel 55 extends from chamber 54 to control valve assembly 60. As depicted in FIG. 4, control valve assembly 60 comprises a fluid pressure sealing sliding valve. However, it is to be observed that said fluid pressure sealing valve assembly can similarly comprise a gate valve, ball valve or other valve assembly. In a preferred embodiment, control valve assembly 60 comprises elongate valve body 61 having longitudinal bore 62. Valve body 61 is slidably received within control valve seat 62.

In the closed configuration depicted in FIG. 4, incompressible fluid is sealed within chamber 54 by valve assembly 60. However, when valve body 61 shifts within control valve seat 62, transverse ports extending though valve body 61 are shifted into communication with bore 62 and become open to flow channel 55. In such a shifted or "open" configuration, incompressible fluid within chamber 54 can flow from said chamber as described more fully below.

Still referring to FIG. 4, a chamber 74 is formed between electronics housing 70 and electronic sub cover 73. Magnetic solenoid 80 is disposed within said chamber 74. In a preferred embodiment, said chamber 74 contains a compressible fluid maintained at or near atmospheric pressure when control valve assembly 60 is in a closed position. Magnetic solenoid 80 is beneficially electronically connected to an electronics assembly 75 also contained in chamber 74.

Said electronics assembly 75 can include, but is not necessarily limited to, at least one electronic counter or processor, latch circuit, rectifier, capacitor and battery. Electronics assembly 75 is also beneficially electronically connected to induction coil 76, also contained within electronics housing 70. As depicted in FIG. 4, a wire 77 can pass through a conduit in electronics housing 70 to provide electrical connection between induction coil 76 and electronics assembly 75. Moreover, in a preferred embodiment, magnetic solenoid 80 is configured in accordance with the magnetic solenoid apparatus disclosed in that certain pending patent application filed Feb. 14, 2013 and having Publication No. WO2013123111, which is incorporated by reference herein for all purposes.

Figure 5A:
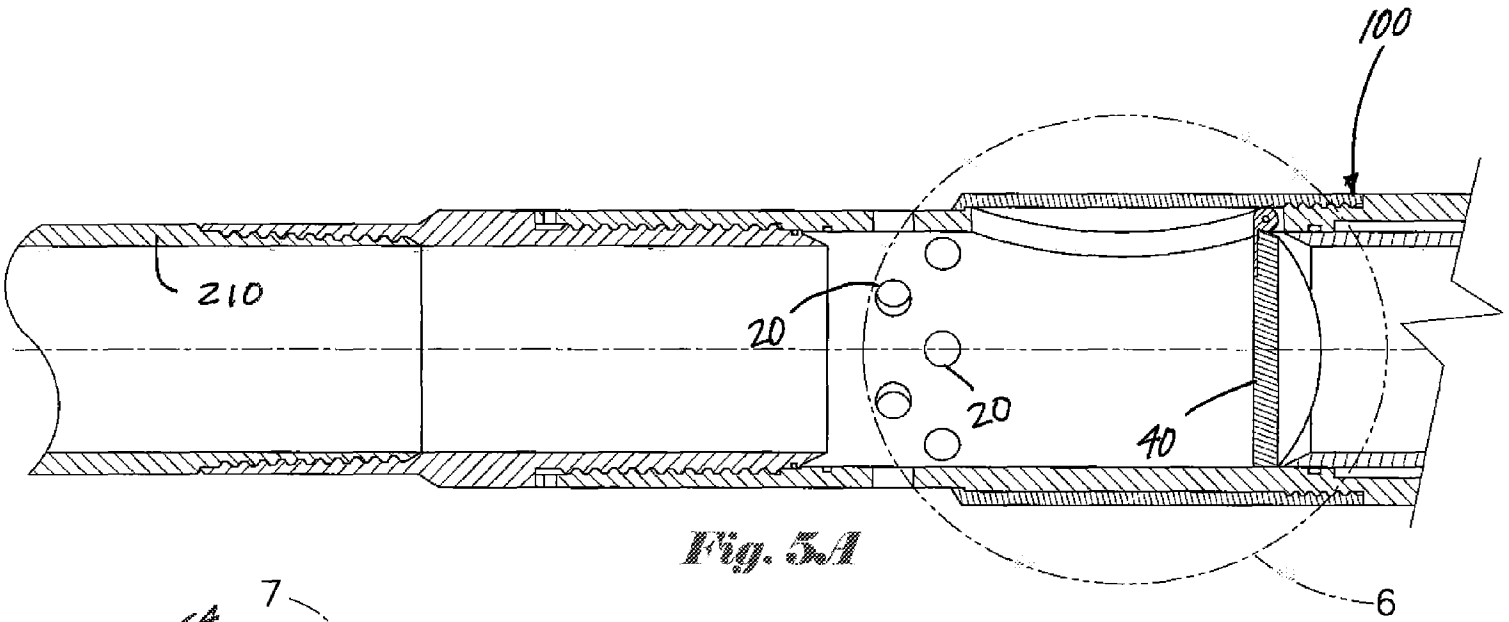
FIG. 5A depicts a side sectional view of a valve subassembly of an equalization assembly of the present invention.
Figure 5B:
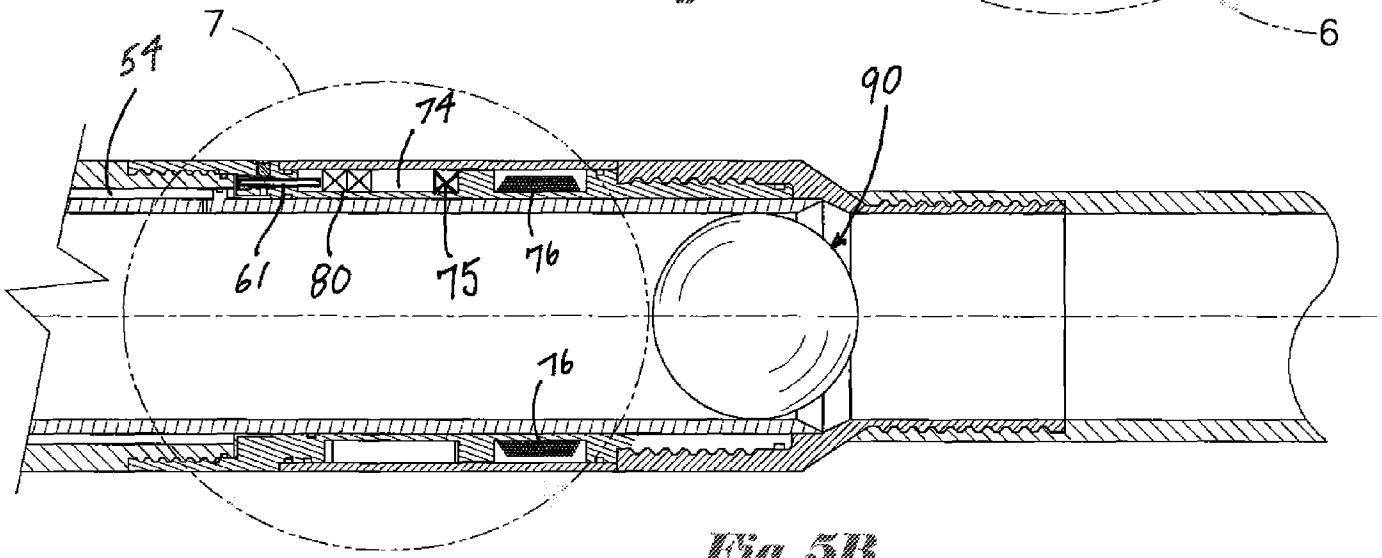
FIG. 5B depicts a side sectional view of an actuation subassembly of an equalization assembly of the present invention.

FIG. 5B depicts a side sectional view of actuation sub-assembly 50 of equalization assembly 100 of the present invention after control valve 60 has opened. FIG. 5A depicts a side sectional view of valve sub-assembly 10 of equalization assembly 100 of the present invention after sleeve 30 has shifted, thereby exposing equalization ports 20 and allowing flapper 40 to move into a closed position.

In operation, a desired number of equalization assemblies 100 are conveyed on a tubular string and deployed in place within a wellbore, as depicted in FIG. 1. Thereafter, an actuation control device 90 can be introduced into the inner through-bore of said tubular string, typically at the earth's surface. Said actuation control device 90 can comprise a pump-able dart, ball, canister, or container, and can be conveyed into said well by fluid flow or mechanically via coil tubing, jointed tubing or wire line. Said actuation control device 90 can include at least one encased or partially encased magnet, or other apparatus capable of generating a magnetic field.

Each deployed equalization assembly 100 is preset to predetermined counter number. If deployed as a series wherein each equalization assembly 100 will operate separately, then each such assembly will be preset to respond to its own unique counter number. Conversely, if deployed as a group wherein two or more equalization assemblies 100 will actuate substantially simultaneously, then each equalization assembly in said group can be preset to respond to a predetermined shared counter number.

Referring to FIGS. 5A and 5B, as actuation control device 90 passes through equalization assembly 100, the magnetic field created by said actuation control device 90 generates an electrical current as it passes by, through or in proximity to induction coil 76. Said electrical current passes through a rectifier where said current is converted to a direct current impulse which, in turn, registers on an electronic counter included within electronic assembly 75. This process is repeated for all equalization assemblies 100 in a sequence through which actuation control device 90 passes.

Figure 7:
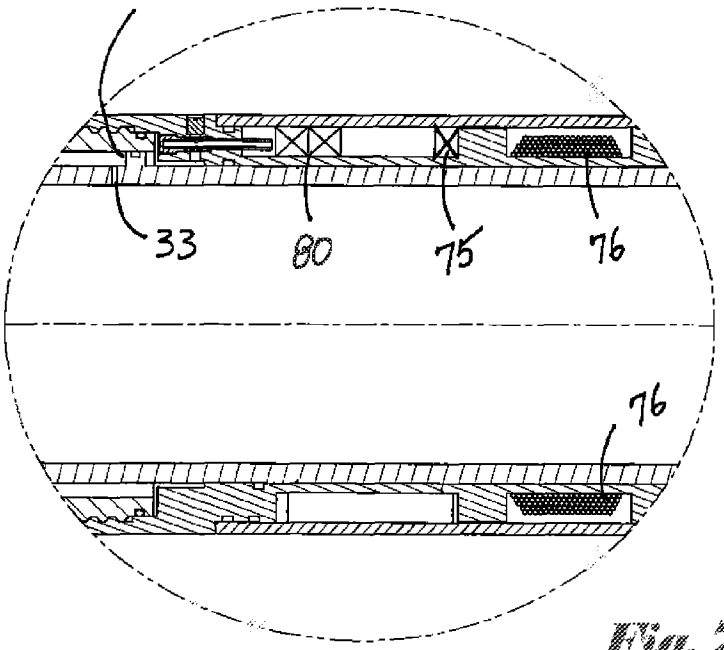
FIG. 7 depicts a detailed view of the area highlighted in FIG. 5B.

In the event that actuation control device 90 passes through an equalization assembly 100 that is preset to actuate when a particular counter number is reached, and that predetermined counter number is achieved, then that specific equalization assembly 100 will actuate. Specifically, referring to FIG. 7, an electronic counter contained within electronics assembly 75 will allow generated direct current impulse to activate a latch circuit, thereby closing an electrical connection between said capacitor, battery and magnetic solenoid 80. When said connection is made, magnetic solenoid 80 activates and moves within chamber 74. Said magnetic solenoid 80 will eventually contact valve body 61 of control valve assembly 60, thereby causing said control valve assembly 60 to open and creating an open fluid flow path between chambers 54 and 74.

When equalization assembly 100 is deployed downhole in a wellbore, the inner through-bore of an associated tubular string typically includes relatively heavy-weight fluids (usually due to deployment of cement slurry or stimulation materials). Elevated hydrostatic pressure from such wellbore fluids, as well as any surface pump pressure, is communicated through-bores 33 in sliding sleeve 30 and acts on fluid piston 34.

While control valve assembly 60 is closed, incompressible fluid is trapped within chamber 54, and prevents sleeve 30 from shifting or otherwise moving. However, after control valve assembly 60 is opened and a fluid flow path through control valve assembly 60 is formed, incompressible fluid contained within chamber 54 can evacuate chamber 54 and flow into chamber 74 (which is maintained at a lower fluid pressure). With said incompressible fluid no longer trapped within chamber 54, said elevated wellbore pressure acts on piston 34 and is able to shift sliding sleeve 30. Moreover, incompressible fluid contained within chamber 74 is prevented from flowing in the reverse direction (i.e., back into chamber 54) by control valve assembly 60 which, in turn, prevents sliding sleeve 30 from moving in a reverse direction.

Figure 6:
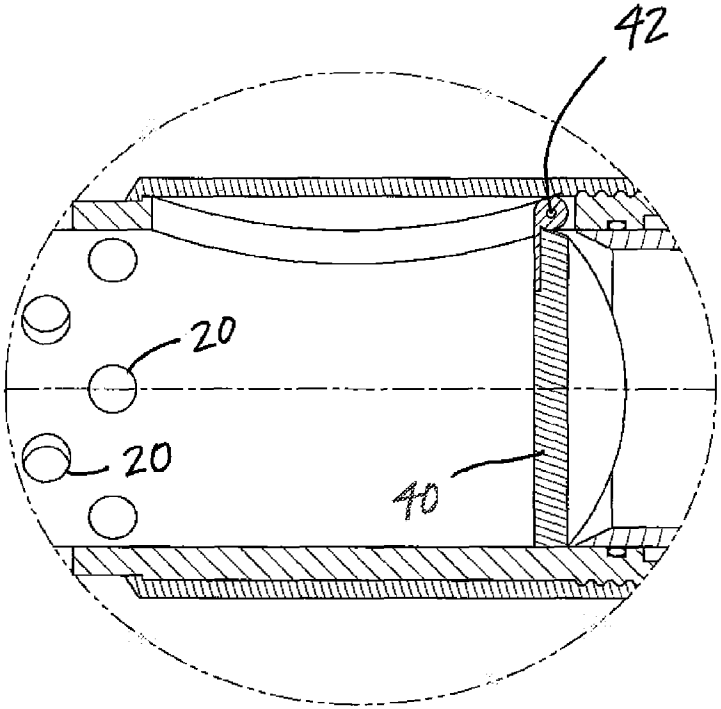
FIG. 6 depicts a detailed view of the area highlighted in FIG. 5A.

Referring to FIG. 5A, after sleeve 30 has shifted, equalization ports 20 are exposed and in fluid communication with the internal through-bore of tubular string 210. Further, referring to FIG. 6, with said sleeve 30 shifted, flapper 40 is permitted to pivot about hinge pin 42 to move into a closed position. With said flapper 40 in a closed position, fluid pumped from the earth's surface through the inner through-bore of tubular string 210 is prevented from flowing past closed flapper 40 and is redirected out exposed equalization ports 20. Although said valve mechanism is depicted as flapper 40, it is to be observed that other valve configurations including, without limitation, flapper valves, gate valves or sliding valves, can also be used for this purpose. Moreover, in an alternative embodiment, flapper 40 can be removed; after sliding sleeve 30 has shifted, equalization ports 20 are exposed, but a fluid flow pathway also exists through the central through-bore of equalization assembly 100.

In a preferred embodiment, no physical contact or mechanical interference is required between actuation control device 90 and any other components of equalization assembly 100 including, without limitation, external housing member 11 or sleeve member 30, in order to actuate equalization assembly 100 and shift sleeve member 30.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for selectively opening a plurality of downhole pathways comprising:

a) a housing member having a central through-bore, an inner surface, an outer surface and a plurality of apertures extending from said inner surface to said outer surface;

b) a sleeve member slidably disposed within said through-bore coupled for movement between a first locked position and a second position, wherein said sleeve member is substantially aligned with said apertures in said first position, and substantially clear of said apertures in said second position;

c) an actuation assembly for controlling movement of said sleeve member between said first and second positions;

d) at least one actuation control device adapted to pass through said through-bore of said housing member;

e) an induction coil;

f) a counter for registering a count each time an actuation control device passes said induction coil; and g) a valve assembly for unlocking said sleeve member when said counter registers a predetermined number of counts.

2. The apparatus of claim 1, wherein said at least one actuation control device generates a magnetic field.

3. The apparatus of claim 2, wherein said magnetic field generates an electrical current in said induction coil when said at least one actuation control device passes said induction coil, and said counter registers a count in response to said electrical current.

4. The apparatus of claim 1, further comprising a flapper hingedly connected to said housing member, wherein said flapper is disposed between said housing member and said sleeve member when said sleeve member is in said first position, and blocks said through-bore when said sleeve is in said second position.

5. The apparatus of claim 1, wherein physical contact between said at least one actuation control device and any other component of said apparatus is not required in order to move said sleeve member from said first to said second position.

6. A method for selectively opening a plurality of downhole pathways comprising:

a) deploying at least one equalization assembly in a wellbore, said equalization assembly comprising:

i) a housing member having a central through-bore, an inner surface, an outer surface and a plurality of apertures extending from said inner surface to said outer surface;

ii) a sleeve member slidably disposed within said through-bore coupled for movement between a first locked position and a second position, wherein said sleeve member is substantially aligned with said apertures in said first position, and substantially clear of said apertures in said second position;

iii) a counter for registering a count each time an actuation control device passes said equalization assembly;

b) passing an actuation control device through said through-bore of said housing member;

c) shifting said sleeve member from said first position to said second position when said counter registers a predetermined number of counts.

7. The method of claim 6, wherein said at least one actuation control device generates a magnetic field.

8. The method of claim 7, wherein said equalization assembly further comprises an induction coil.

9. The method of claim 8, wherein said magnetic field of said at least one actuation control device generates an electrical current in said induction coil when said at least one actuation control device passes said induction coil, and said counter registers a count in response to said electrical current.

10. The method of claim 9, wherein said equalization assembly further comprises:

a) a first fluid chamber;

b) a second fluid chamber; and c) a valve assembly having an open position and a closed position, said valve assembly disposed between said first and second fluid chambers.

11. The method of claim 10, wherein said valve assembly forms a barrier for containing incompressible fluid in said first fluid chamber when said valve assembly is in a closed position, and said incompressible fluid prevents said sleeve member from moving from said first position to said second position.

12. The method of claim 11, wherein said incompressible fluid displaces from said first fluid chamber to said second fluid chamber when said valve assembly is in an open position, thereby allowing said sleeve member to move from said first position to said second position.

13. The method of claim 12, further comprising a magnetic solenoid.

14. The method of claim 13, wherein said magnetic solenoid shifts said valve assembly from said closed position to said open position when said counter registers a predetermined number of counts.

15. The method of claim 6, wherein physical contact between said at least one actuation control device and any other component of said equalization assembly is not required in order to move said sleeve member from said first to said second position.

16. The method of claim 6, further comprising a flapper hingedly connected to said housing member, wherein said flapper is disposed between said housing member and said sleeve member when said sleeve member is in said first position, and blocks said through-bore when said sleeve is in said second position.

* * * * *